US010982675B2

(12) United States Patent
Park et al.

(10) Patent No.: US 10,982,675 B2
(45) Date of Patent: Apr. 20, 2021

(54) ROTARY COMPRESSOR WITH GROOVE FOR SUPPLYING OIL

(71) Applicant: LG ELECTRONICS INC., Seoul (KR)

(72) Inventors: Joonhong Park, Seoul (KR); Bumdong Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 177 days.

(21) Appl. No.: 16/260,313

(22) Filed: Jan. 29, 2019

(65) Prior Publication Data

US 2019/0234407 A1 Aug. 1, 2019

(30) Foreign Application Priority Data

Jan. 30, 2018 (KR) ..... 10-2018-0011647

(51) Int. Cl.
*F04C 29/02* (2006.01)
*F04C 18/356* (2006.01)
(Continued)

(52) U.S. Cl.
CPC ..... *F04C 29/02* (2013.01); *F04C 18/3564* (2013.01); *F04C 23/001* (2013.01);
(Continued)

(58) Field of Classification Search
CPC ..... F04C 29/22; F04C 29/0057; F04C 29/02; F04C 18/3564; F04C 18/356;
(Continued)

(56) References Cited

U.S. PATENT DOCUMENTS 5,314,318 A 5/1994 Hata et al.
5,542,831 A * 8/1996 Scarfone ..... F04C 18/3562 418/60
(Continued)

FOREIGN PATENT DOCUMENTS

JP 2008-298037 12/2008
KR 20-1998-0015241 6/1998
(Continued)

OTHER PUBLICATIONS

Korean Notice of Allowance dated Feb. 26, 2019.
European Search Report dated Jun. 14, 2019.

*Primary Examiner* — Deming Wan
(74) *Attorney, Agent, or Firm* — Ked & Associates LLP

(57) ABSTRACT

A rotary compressor may include a rotational shaft coupled to a drive motor and having a central passage, an eccentric portion provided eccentrically from the rotational shaft, a cylinder through which the rotational shaft passes, the cylinder forming a compression chamber in which refrigerant is accommodated, a roller an inner circumferential surface of which is in close contact with an outer circumferential surface of the eccentric portion, the roller rolling and compressing a refrigerant, a vane inserted into the cylinder, the vane protruding from an inner circumferential surface of the cylinder when backpressure is applied to the vane to be in contact with an outer circumferential surface of the roller, and partitioning the compression chamber into a plurality of chambers; a plurality of oil supply grooves on an outer circumferential surface of the eccentric portion; and an oil supply passage that communicates the central passage with the oil supply grooves.

15 Claims, 14 Drawing Sheets

(51) Int. Cl.
*F04C 29/00* (2006.01)
*F04C 23/00* (2006.01)
*F01C 21/08* (2006.01)

(52) U.S. Cl.
CPC ..... *F04C 23/008* (2013.01); *F04C 29/0057* (2013.01); *F04C 29/023* (2013.01); *F01C 21/0845* (2013.01); *F04C 2210/26* (2013.01); *F04C 2240/40* (2013.01)

(58) Field of Classification Search
CPC ..... F04C 23/008; F04C 23/001; F04C 2240/603; F04C 29/023
See application file for complete search history.

(56) References Cited

U.S. PATENT DOCUMENTS

| | | | | |
|---|---|---|---|---|
| 6,024,548 | A * | 2/2000 | Bushnell | F04C 29/023 418/94 |
| 6,171,076 | B1 * | 1/2001 | Gannaway | F01C 21/0809 417/244 |
| 2005/0019192 | A1 * | 1/2005 | Lee | F04C 28/04 418/23 |
| 2016/0040673 | A1 * | 2/2016 | Lee | F04C 29/028 418/55.6 |

FOREIGN PATENT DOCUMENTS

| | | |
|---|---|---|
| KR | 10-2009-0012860 | 2/2009 |
| KR | 10-2010-0112488 | 10/2010 |
| KR | 10-2011-0015854 | 2/2011 |

* cited by examiner

ROTARY COMPRESSOR WITH GROOVE FOR SUPPLYING OIL

CROSS-REFERENCE TO RELATED APPLICATION(S)

This application claims priority under 35 U.S.C. § 119 to Korean Application No. 10-2018-0011647, filed in Korea on Jan. 30, 2018, whose entire disclosure is herein incorporated by reference.

BACKGROUND

1. Field

A rotary compressor provided with a groove for supplying oil between an outer circumferential surface of an eccentric portion and an inner circumferential surface of a roller is disclosed herein.

2. Background

A compressor is applied to a vapor compression type refrigeration cycle, such as a refrigerator or an air conditioner, for example. The compressor may be classified into an indirect suction type and a direct suction type according to a method for suctioning a refrigerant into a compression chamber.

The indirect suction type is a type in which a refrigerant circulating through a refrigeration cycle is suctioned into the compression chamber after being introduced into an inner space of a case of the compressor, and the direct suction type is a type in which the refrigerant is directly suctioned into the compression chamber, unlike the indirect suction type. The indirect suction type may be referred to as a "low-pressure type compressor" and the direct suction type may be referred to as a "high-pressure type compressor".

The low-pressure type compressor is not provided with an accumulator as a liquid refrigerant or oil is filtered in the inner space of the case of the compressor as the refrigerant first flows into the inner space of the case of the compressor. Conversely, the high-pressure type compressor is provided with an accumulator on a suction side rather than the compression chamber in order to prevent the liquid refrigerant or oil from flowing into the compression chamber.

The compressor may be divided into a rotary type and a reciprocating type according to how to compress a refrigerant is compressed. The rotary type compressor is a type in which a volume of a compression chamber is varied by a rolling piston (hereinafter, referred to as "a roller") that rotates or performs a turning movement in a cylinder. The reciprocating type compressor is a type in which a volume of a compression chamber is varied by a roller that reciprocates in the cylinder.

A rotary compressor configured to compress a refrigerant using a rotational force of a drive portion is provided as an example of the rotary type compressor.

Recently, technological development has mainly aimed to increase efficiency of the rotary compressor while making it smaller. Further, studies for obtaining a larger cooling capacity by increasing a variable range of operation speed of a miniaturized rotary compressor have been continuously conducted.

The rotary compressor includes a drive motor and a compression unit disposed in a case configured to form an exterior thereof, and compresses a suctioned refrigerant and then discharges the compressed refrigerant. The drive motor includes a rotor and a stator disposed in this order with respect to a rotational shaft. When power is applied to the stator, the rotor rotates in the stator while rotating the rotational shaft.

The compression unit includes a cylinder configured to form a compression chamber, a roller coupled to the rotational shaft, and a vane configured to partition the compression chamber into a plurality of chambers. In the cylinder, there is provided a roller configured to roll in contact with an inner circumferential surface of the cylinder while rotating with respect to the rotational shaft as the rotational shaft rotates. The roller performs a rotational motion eccentrically from the rotational shaft.

The roller located around the eccentric portion is disposed in a cylinder that forms a cylindrical compression chamber and at least one vane extends from the roller to the compression chamber to divide the compression chamber into a suction area and a compression area. The vane is configured to slide in a groove provided on the cylinder and press a surface of the roller, and the compression chamber is partitioned into the suction area and the compression area by the vane. According to the rotation of the rotational shaft, as the suction area gradually increases, fluid is suctioned into the suction area. At the same time, as the compression area gradually decreases, fluid in the compression chamber is compressed.

As an outer circumferential surface of the eccentric portion provided eccentrically from the rotational shaft is in close contact with an inner circumferential surface of the roller, the roller is located eccentrically in the compression chamber. As the rotational shaft rotates, the roller also rotates. Friction occurs at a portion where the outer circumferential surface of the eccentric portion and the inner circumferential surface of the roller are in close contact with each other. In general, lubrication is performed through an oil supply in order to reduce friction acting between the outer circumferential surface of the eccentric portion eccentric from the rotational shaft and the inner circumferential surface of the roller.

In a conventional rotary compressor, a mechanical loss due to the friction acting between the outer circumferential surface of the eccentric portion eccentric from the rotational shaft and the inner circumferential surface of the roller comprises 50% or more of the total mechanical loss, so that reliability of a device is lowered or a drive efficiency is degraded. Therefore, it is required to optimize a lubrication structure between the eccentric portion and the roller eccentric from the rotational shaft in order to reduce the friction acting between the outer circumferential surface of the eccentric portion and the inner circumferential surface of the roller.

BRIEF DESCRIPTION OF THE DRAWINGS

Embodiments will be described in detail with reference to the following drawings in which like reference numerals refer to like elements, and wherein.

DETAILED DESCRIPTION

Figure 1:
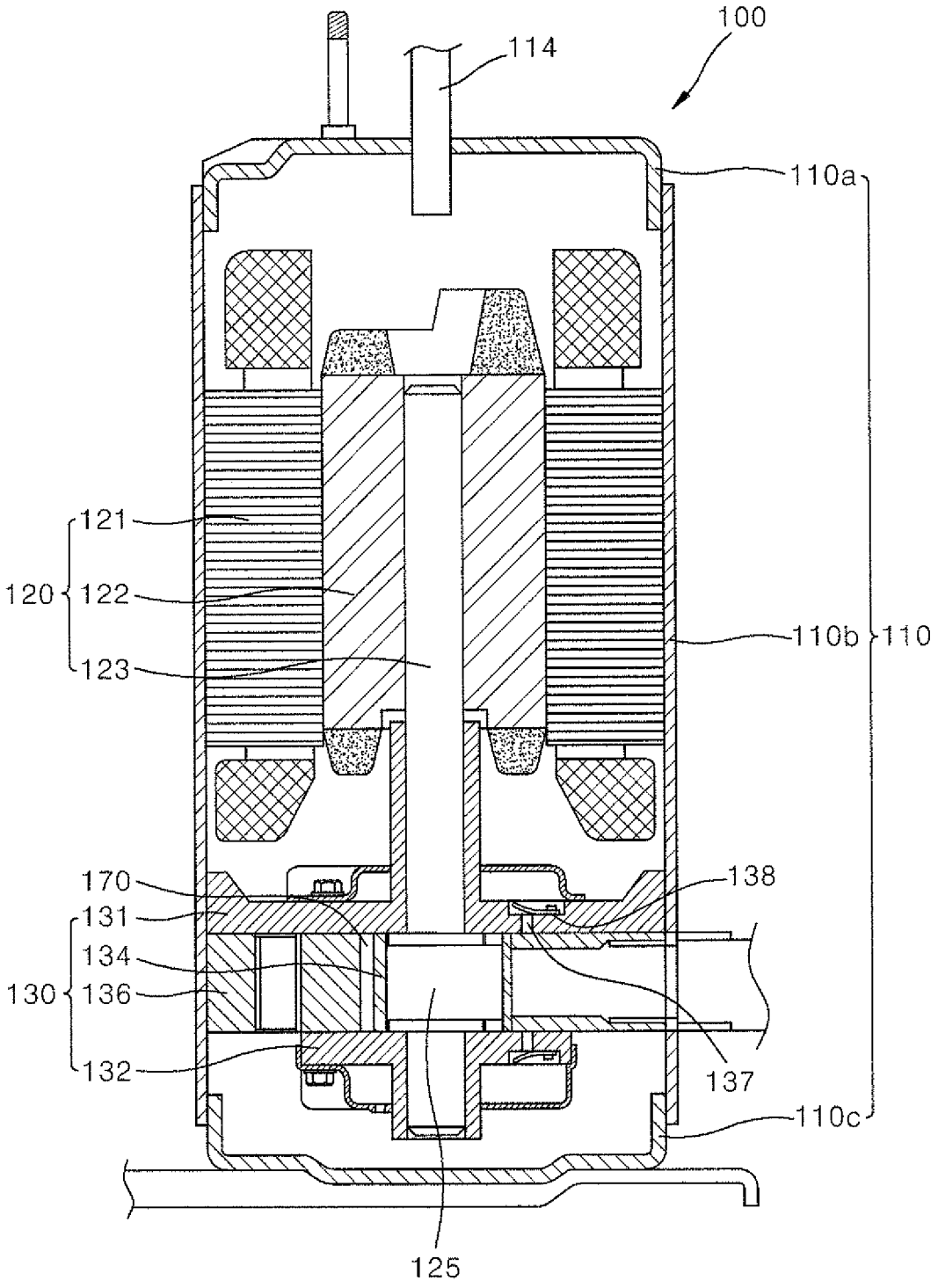
FIG. 1 is a cross-sectional view of an inside of a rotary compressor according to an embodiment.

Hereinafter, a rotary compressor according embodiments will be described with reference to the accompanying drawings. Wherever possible like reference numerals have been used to indicate like elements, and repetitive disclosure has been omitted.

A singular noun, e.g. "a," "an," "the," includes a plural of that noun unless specifically stated otherwise.

In the description of embodiments, the detailed description of well-known related configurations or functions has been omitted when it is deemed that such description will cause ambiguous interpretation of embodiments.

It should be noted that that the accompanying drawings are merely provided to facilitate the understanding of the technical idea disclosed in this specification and should not be construed as limiting the technical idea, and the disclosure covers all modifications, equivalents and alternatives falling within the spirit and scope.

Figure 2:
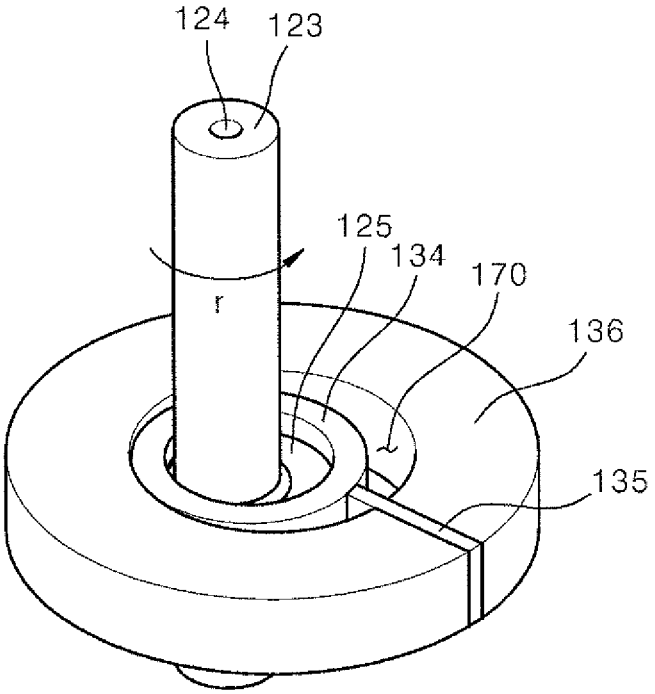
FIG. 2 is an enlarged view of an inside of the compression unit of FIG. 1.

FIG. 1 is a cross-sectional view of a general internal structure of a rotary compressor according to an embodiment. FIG. 2 is an enlarged view of an inside of the compression unit of FIG. 1.

As shown in FIG. 1, the rotary compressor according to embodiments may include not only a vertical type rotary compressor in which a rotational shaft extends vertically but also a horizontal type rotary compressor in which a rotational shaft extends laterally.

Rotary compressor 100 may include a case 110, a drive motor 120, and a compression unit 130. The case 110, which may form an exterior of the rotary compressor 100, may have a cylindrical shape that extends along one direction, and may extend along an extending direction of a rotational shaft 123.

A cylinder 136 configured to form a compression chamber 170 may be installed in the case 110 so as to accommodate and compress suctioned refrigerants and then discharge the compressed refrigerants. The case 110 may include a first shell 110*a*, a second shell 110*b*, and a third shell 110*c* The drive motor 120 and the compression unit 130 may be fixed to an inner surface of the second shell 110*b*. The first shell 110*a* and the third shell 110*c* may be located at one or a first side and the other or a second side of the second shell 110*b*, respectively, thereby an exposure to an outside, with respect to components located inside the case 110, is limited.

The compression unit 130 may perform a role of compressing and discharging refrigerant. The compression unit 130 may include a roller 134, a vane 135, a cylinder 136, a first block 131, and a second block 132.

The drive motor 120 may be located at one side of the compression unit 130 and may serve to provide power for compressing the refrigerant. The drive motor 120 may include a stator 121, a rotor 122, and the rotational shaft 123.

The stator 121 may be installed and fixed to an inside of the case 110 and may be mounted on an inner circumferential surface of the case 110, which may be cylindrical, in a shrink fit manner. Further, the stator 121 may be fixed to an inner circumferential surface of the second shell 110*b*.

The rotor 122 may be spaced apart from the stator 121 and may be disposed on an inner side of the stator 121. When power is applied to the stator 121, the rotor 122 may rotate by means of a force occurring in accordance with a magnetic field formed between the stator 121 and the rotor 122, and a rotational force may be transferred to the rotational shaft 123 that passes through a center of the rotor 122.

A suction port (not shown) may be installed at one side of the second shell 110*b* and a discharge pipe 114 may be installed at one side of the first shell 110*a* so that the refrigerant may flow out from an interior of the case 110. The suction port (not shown) may be connected to a suction pipe 113. The suction pipe 113 may pass through the case 110 to be connected to an evaporator (not shown). The discharge pipe 114 may pass through the case 110 to be coupled thereto. The discharge pipe 114 may be connected to a condenser (not shown).

The compression unit 130 installed in the case 110 may compress a suctioned refrigerant and then discharge the compressed refrigerant. The suction and discharge of the refrigerant may be performed in the cylinder 136 in which the compression chamber 170 is formed.

The cylinder 136 through which the rotational shaft 123 passes may form the compression chamber 170 in which refrigerant may be received in a central portion thereof, and may be provided with a suction port (not shown) and a discharge port (not shown) that communicate with the compression chamber 170. In a process in which the refrigerant introduced through the suction port (not shown) formed in the cylinder 136 is compressed and then discharged, an end of the discharge port (not shown) may be expanded, and thereby the compressed refrigerant may be more smoothly discharged.

The cylinder 136 may be provided with the vane 135 capable of partitioning the compression chamber 170 into a plurality of chambers. That is, the chamber may be defined by the cylinder 136, the roller 134, the first block 131, the second block 132, and the vane 135. A spring capable of applying a backpressure to the other or a second end of the vane 135 may be provided to maintain a state in which one or first end of the vane 135 is in contact with an outer circumferential surface of the roller 134 which is rotated eccentrically from a rotational center.

The vane 135 may be a plurality of vanes 135. The compression chamber 170 may be partitioned into a plurality of chambers by the plurality of vanes 135.

The roller 134 located around the eccentric portion 125 eccentric from the rotational shaft 123 is located in the cylinder 136 that forms the compression chamber 170, which may be cylindrical, and the vane 135 may protrude from the cylinder 136, so that the compression chamber 170 may be partitioned into a suction chamber I communicating with the suction chamber and a discharge port h communicating with the discharge port.

The cylinder 136 may be provided with the eccentric portion 125 formed eccentrically from the rotational shaft 123 and the roller 134 fitted to the eccentric portion 125. An outer circumferential surface of the eccentric portion 125 may be in close contact with an inner circumferential surface of the roller 134 and an outer circumferential surface of the roller 134 may be in close contact with an inner circumferential surface of the cylinder 136 so that the roller 134 rolls in a state in which the outer circumferential surface of the roller 134 and the inner circumferential surface of the cylinder 136 contact each other at a contact point B which is a point at which the outer circumferential surface of the roller 134 is in contact with the inner circumferential surface of the cylinder 136 as the rotational shaft 123 rotates. When the rotational shaft 123 is rotated by the drive motor 120, the roller 134 in close contact with the outer circumferential surface of the eccentric portion 125 performs a pivoting motion in an inner space of the cylinder 136, and a volume of the suction chamber I between the roller and the vane 135 is increased, thereby refrigerant gas may be suctioned into the suction chamber I.

At the same time, with respect to the firstly suctioned refrigerant, the roller 134 rolls in a state in which the outer circumferential surface of the roller 134 is in close contact with the inner circumferential surface of the cylinder 136, and a volume of the discharge chamber h is reduced between the roller 134 and the vane 135, thereby compressing the refrigerant. When the refrigerant gas reaches a predetermined pressure, a discharge valve 138 that closes a discharge hole 137 is opened and the refrigerant gas can be discharged from the compression chamber 170 through the discharge hole 137.

As the roller 134 rotates in the compression chamber 170 in a state eccentrically from the rotational center according to the rotation of the rotational shaft 123, the volume of the suction chamber I is gradually increased to suction the refrigerant gas into the suction chamber I. At the same time, the volume of the discharge chamber h is gradually reduced to compress the refrigerant in the discharge chamber h.

Figure 3:
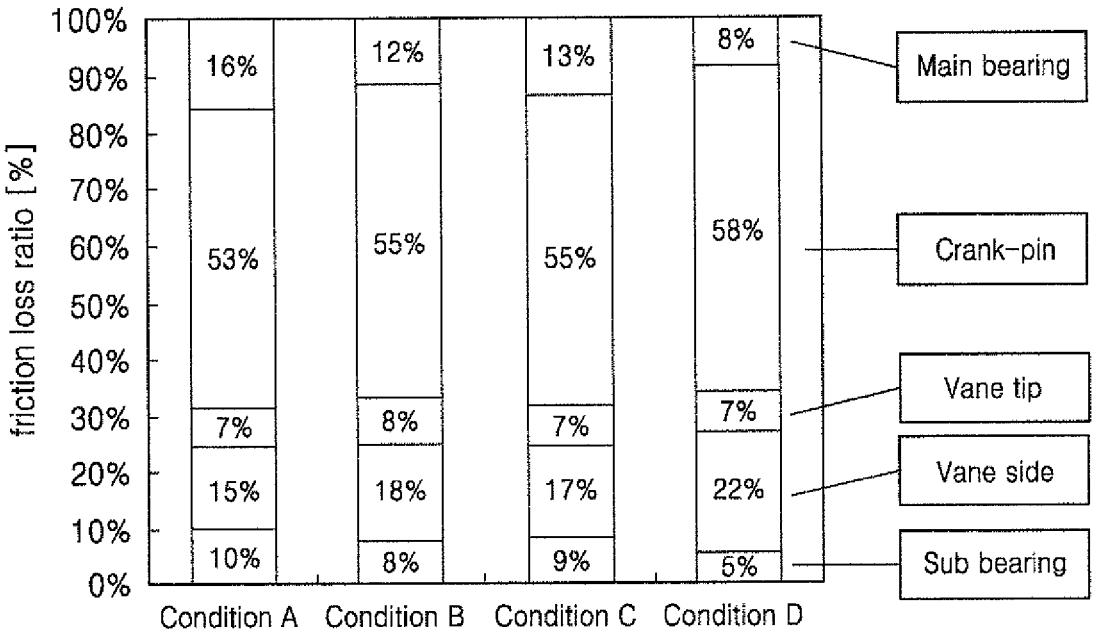
FIG. 3 is a graph showing a rate at which a loss due to friction occurs in a rotary compressor.
Figure 4:
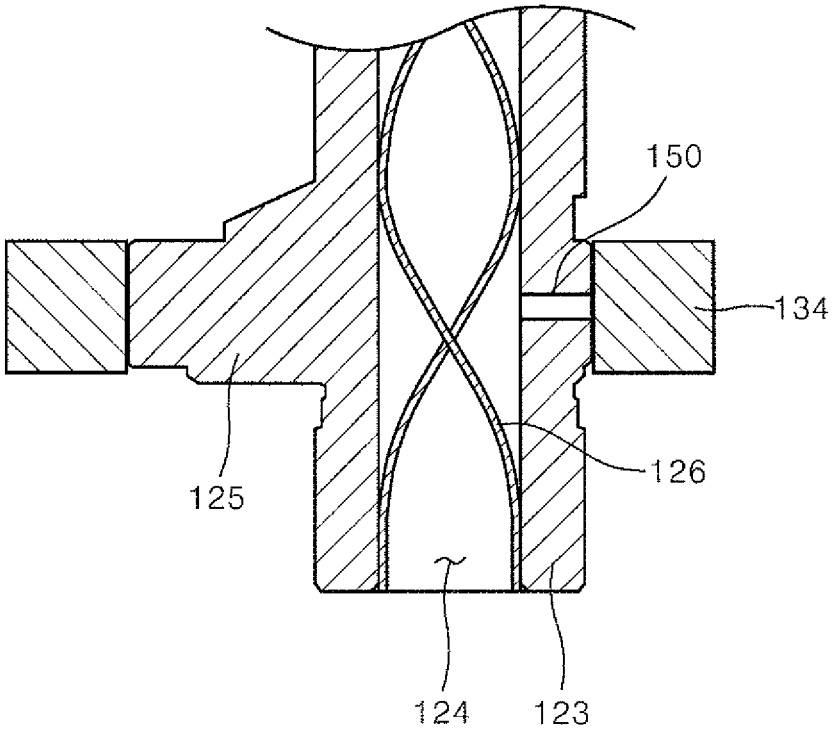
FIG. 4 shows a state in which oil is supplied through a central passage according to an embodiment.
Figure 5:
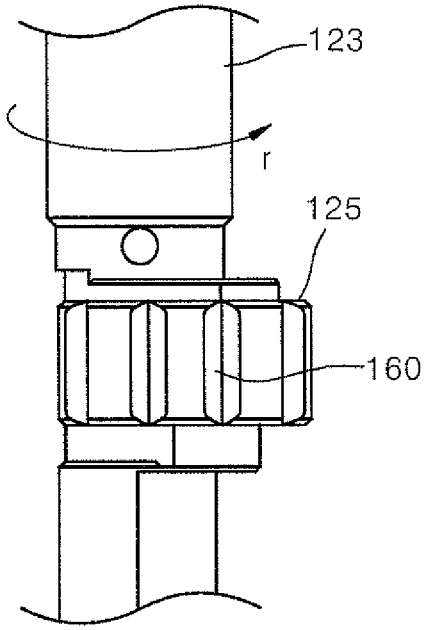
FIG. 5 is a side view of an eccentric portion provided with a plurality of grooves according to an embodiment.

FIG. 3 is a graph showing a rate at which a loss due to friction occurs in a rotary compressor according to an embodiment FIG. 4 shows a state where oil is supplied through a central passage 124, and FIG. 5 is a side view of an eccentric portion 125 provided with a plurality of grooves according to an embodiment.

A side portion of the compression chamber 170 may be defined by an inner circumferential surface of the cylinder 136 and an outer circumferential surface of the roller 134. An inner circumferential surface of the roller 134 may be in close contact with an outer circumferential surface of the eccentric portion 125. As the eccentric portion 125 rotates, the roller 134 rolls in a state in which the outer circumferential surface of the roller 134 contacts with the inner circumferential surface of the cylinder 136 to compress the refrigerant.

As the outer circumferential surface of the eccentric portion 125 and the inner circumferential surface of the roller 134 are in close contact with each other, friction occurs between the eccentric portion 125 and the roller 134 when the eccentric portion 125 rotates. A friction loss generated by the friction comprises 50% or more of the total mechanical loss occurring in the compression unit 130, as shown in FIG. 3.

When the friction occurs between the eccentric portion 125 and the roller 134, an efficiency of the compressor may be lowered, and abrasion may occur in the eccentric portion 125 and the roller 134. Therefore, as shown in FIG. 4, oil may be supplied continuously between the outer circumferential surface of the eccentric portion 125 and the inner circumferential surface of the roller 134 in order to reduce the friction generated between the eccentric portion 125 and the roller 134.

The rotational shaft 123 may be a hollow shaft in an inside of which is empty. The hollow portion may be provided with a central passage 124 through which oil may flow. A spiral oil propeller 126 may be inserted into the central passage 124.

The oil propeller 126 may be rotated with the rotational shaft 123 when the rotational shaft 123 is rotated in a state in which the oil propeller 126 is inserted into the central passage 124. The oil propeller 126 may be rotated by the rotation of the rotational shaft 123 so that oil in the rotational shaft 123 may flow through the central passage 124 along the oil propeller 126.

As shown in FIG. 5, according to one embodiment, a rotary compressor may include a plurality of oil supply grooves 160 formed on an outer circumferential surface of eccentric portion 125.

The plurality of oil supply grooves 160 may be disposed on an outer circumferential surface of the eccentric portion 125. Each of the oil supply grooves 160 may have a slot shape formed in a direction parallel to an axial direction of the rotational shaft 123. This is to allow oil discharged from the oil supply groove 160 to be uniformly supplied to the inner circumferential surface of roller 134.

Oil flowing through the central passage 124 may be supplied to the outer circumferential surface of the eccentric portion 125 through the oil supply passage 150 which may provide communication between the outer circumferential surface of the eccentric portion 125 and the central passage 124. The oil supplied to the outer circumferential surface of the eccentric portion 125 may flow into the plurality of oil supply grooves 160 provided on the outer circumferential surface of the eccentric portion 125, as the rotational shaft 123 rotates in a state in which the outer circumferential surface of the eccentric portion 125 is in close contact with the inner circumferential surface of the roller 134. Therefore, even during a low-speed rotation or an inflow of a liquid refrigerant, an oil supply may be continuously supplied between the outer circumferential surface of the eccentric portion 125 and the inner circumferential surface of the roller 134, so that lubricity between the eccentric portion 125 and the roller 134 may be improved.

Further, as the plurality of oil supply grooves 160 is formed on the outer circumferential surface of the eccentric portion 125, a contact area between the outer circumferential surface of the eccentric portion 125 and the inner circumferential surface of the roller 134 is reduced, thereby a friction area between the outer circumferential surface of the eccentric portion 125 and the inner circumferential surface of the roller 134 may be reduced.

As the friction area between the outer circumferential surface of the eccentric portion 125 and the inner circumferential surface of the roller 134 is reduced, mechanical loss due to the friction may be reduced, and it is possible to prevent a device from being damaged due to abrasion caused by the friction. The lubricity may be provided by the continuous oil supply even under conditions where the oil supply may be insufficient, thereby improving an efficiency and reliability of the compressor.

Figure 6:
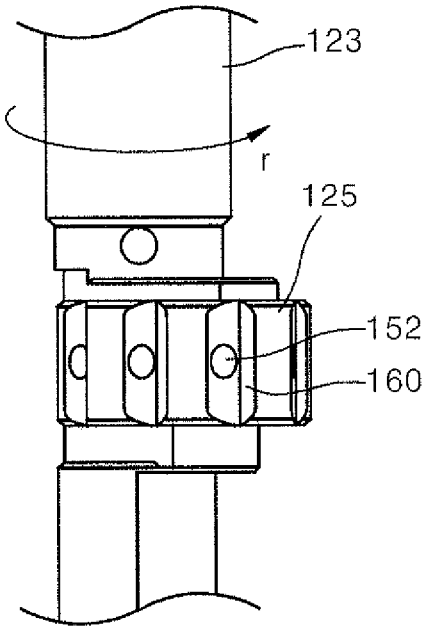
FIG. 6 shows a form of an oil supply groove according to an embodiment.
Figure 7:
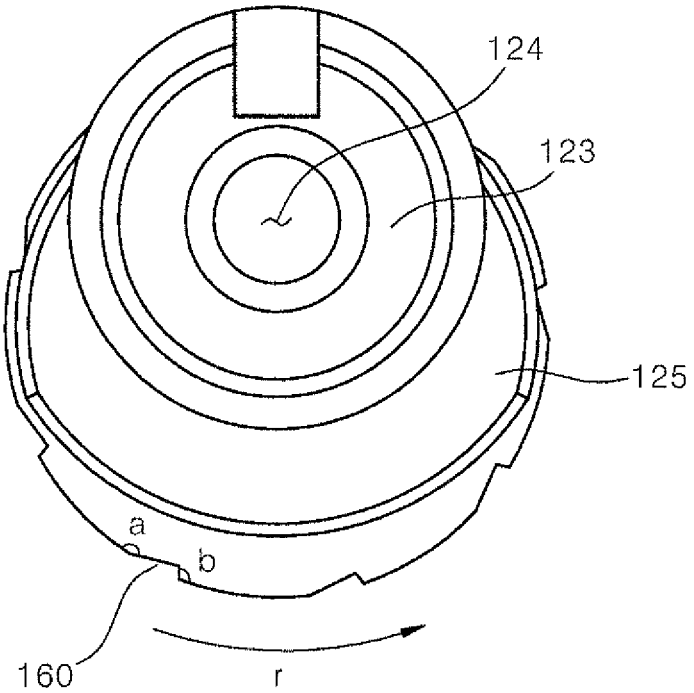
FIG. 7 is a plan view of FIG. 6.

FIG. 6 shows an oil supply groove 160 according to an embodiment. FIG. 7 is a plan view of FIG. 6.

According to an embodiment, as shown in FIGS. 6 and 7, the oil supply groove 160 may be provided with a groove surface disposed rearward with respect to the a rotational direction r of eccentric portion 125 and a groove surface disposed forward with respect to the rotational direction r of the eccentric portion 125.

An angle a between the groove surface disposed rearward and an outer circumferential surface of the eccentric portion 125 may be an obtuse angle. This is to reduce a resistance of fluid generated when oil stored in the oil supply groove 160 is discharged. Further, the oil discharged from the oil supply groove 160 may smoothly flow toward the inner circumferential surface of roller 134.

The oil stored in the oil supply groove 160 may be discharged by the centrifugal force generated when the eccentric portion 125 rotates. The flow resistance of the oil may be reduced, so that the stored oil may effectively lubricate the space between the roller 134 and the eccentric portion 125.

In the oil supply groove 160, when the grooved surface disposed rearward with respect to the rotational direction r has an obtuse angle with the outer circumferential surface of the eccentric portion 125, the groove surface disposed rearward with respect to the rotational direction r has an acute angle with the inner circumferential surface of the roller 134. In this state, it can rotate with the outer circumferential surface of the eccentric portion 125 being in close contact with the inner circumferential surface of the roller 134.

Therefore, when the eccentric portion 125 rotates in close contact with the inner circumferential surface of the roller 134, the oil contained in the oil supply groove 160 may smoothly flow between the outer circumferential surface of the eccentric portion 125 and the inner circumferential surface of the roller 134. That is, as the angle between the groove surface disposed rearward with respect to the rotational direction r and the inner circumferential surface of the roller 134 is smaller, a reduction ratio of a space between the groove surface disposed rearward with respect to the rotational direction r and the inner circumferential surface of the roller 134 is smaller. The oil contained in the oil supply groove 160 may smoothly flow between the outer circumferential surface of the eccentric portion 125 and the inner circumferential surface of the roller 134.

Further, the angle a between the groove surface arranged rearward with respect to the rotational direction r of the eccentric portion 125 and the outer circumferential surface of the eccentric portion 125 is larger than the angle b between the groove surface disposed forward with respect to the rotational direction r of the eccentric portion 125 and the outer circumferential surface of the eccentric portion 125. If the angle b between the groove surface disposed forward with respect to the rotational direction r and the outer circumferential surface of the eccentric portion 125 is relatively smaller, it is possible to provide more oil supply grooves 160 on the outer circumferential surface of the eccentric portion 125. In the oil supply groove 160, as the angle b between the groove surface disposed forward with respect to the rotational direction r and the outer circumferential surface of the eccentric portion 125 is smaller, it is possible to reduce a distance between the groove surface forward in the rotational direction r and the groove surface rearward in the rotational direction r and the oil may be smoothly discharged from the oil supply groove 160.

According to one embodiment, the oil supply groove 160 may be provided with an oil supply hole 152. The oil supply hole 152 provided in the oil supply groove 160 may communicate with an oil supply passage 150 so that the oil in the central passage 124 may be directly supplied to the oil supply groove 160 along the oil supply passage 150. The oil supplied directly to the oil supply groove 160 may lubricate a close contact portion between the outer circumferential surface of the eccentric portion 125 and the inner circumferential surface of the roller 134 as the eccentric portion 125 rotates. Oil supply holes 152 may be formed on the plurality of oil supply grooves 160, respectively, so that oil may be supplied smoothly.

Figure 8:
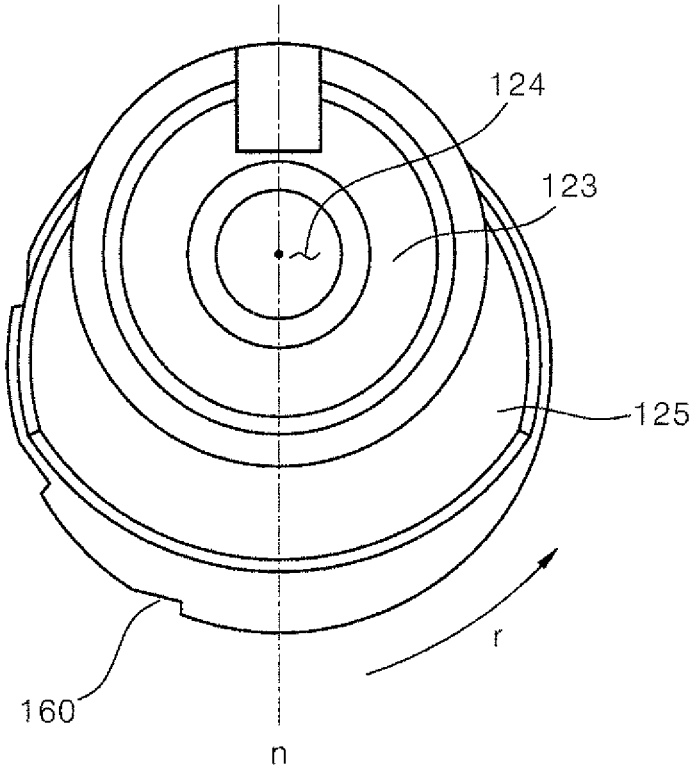
FIG. 8 shows an area where an oil supply groove is provided in an eccentric portion according to an embodiment.
Figure 9:
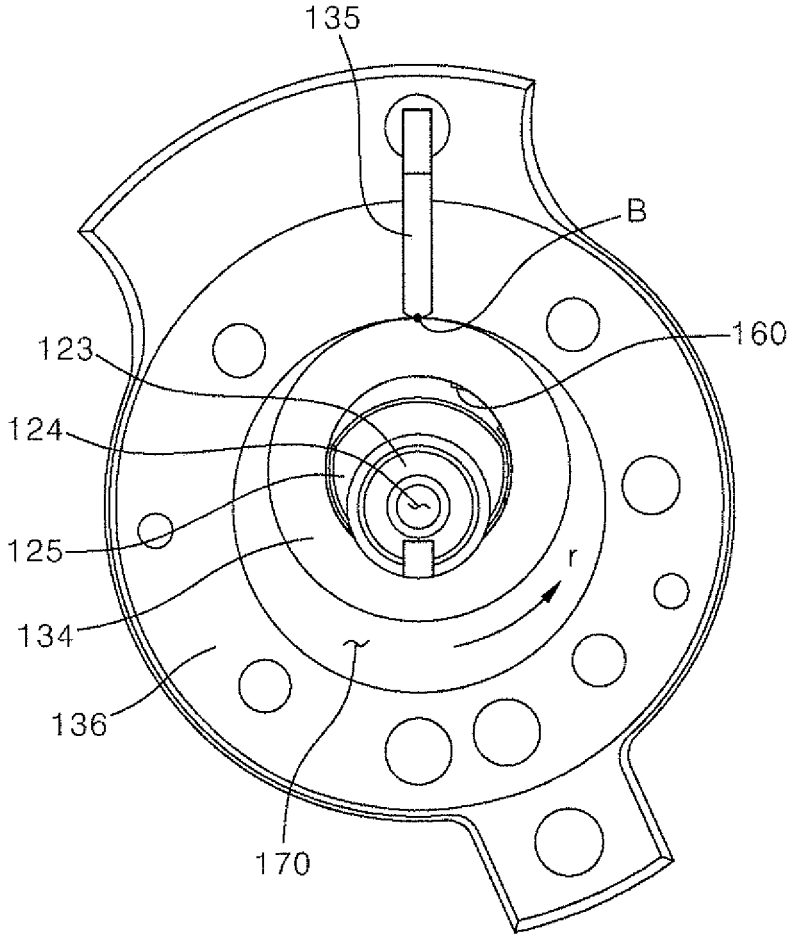
FIG. 9 shows a state in which a point at which an outer circumferential surface of a roller contacts with an inner circumferential surface of a cylinder is located at a vane.
Figure 10:
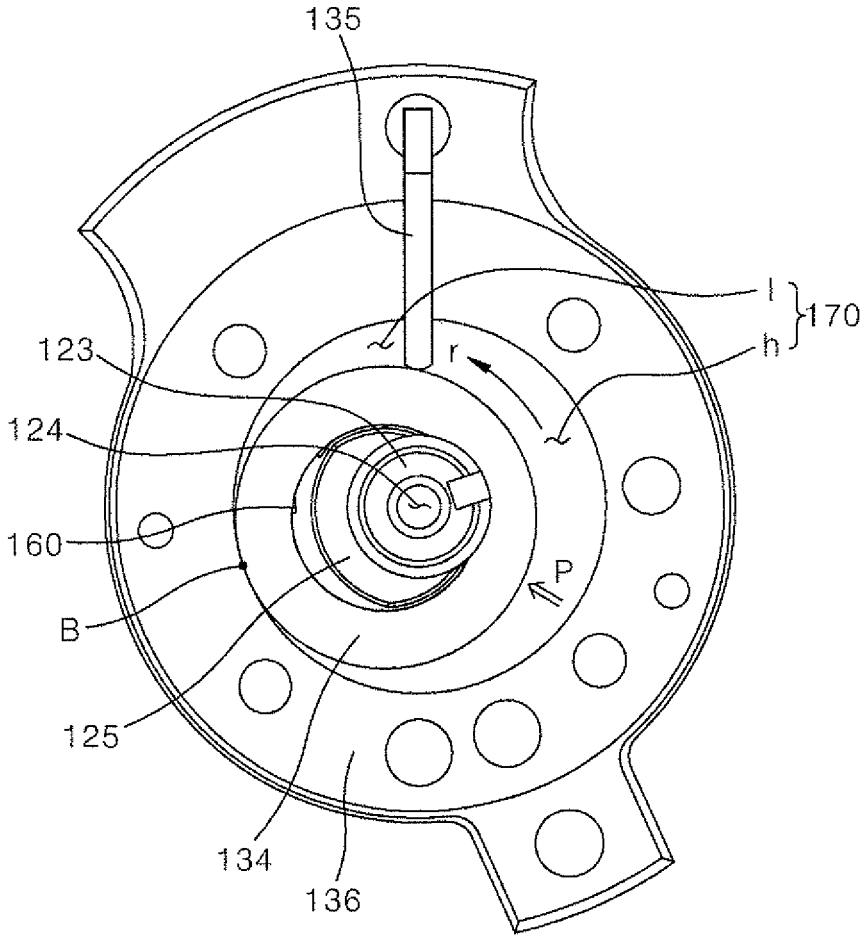
FIG. 10 shows a state in which a compression chamber is partitioned into a suction chamber I and a discharge chamber h by a vane according to an embodiment.
Figure 11:
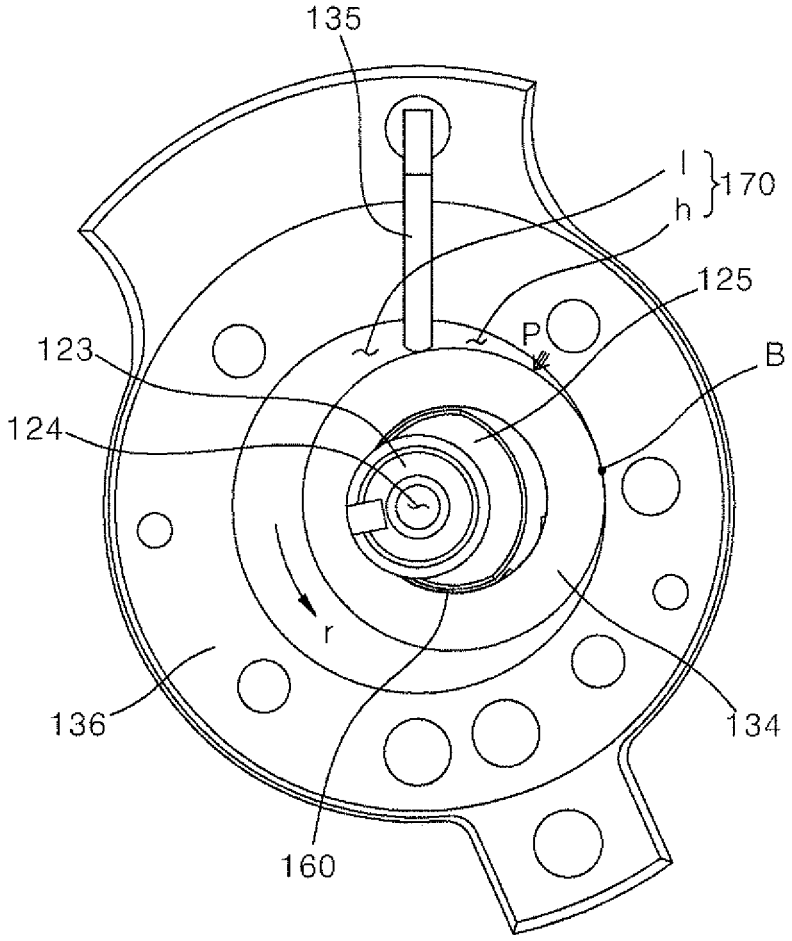
FIG. 11 shows a state in which pressure of a refrigerant accommodated in the discharge chamber h increases.

FIG. 8 shows an area where an oil supply groove is provided on an eccentric portion according to an embodiment. FIGS. 9 to 11 show a state in which a center of pressure P acting on a roller is changed in a cycle of suction and compression.

A side portion of compression chamber 170 may be defined by cylinder 136 and roller 134, and the compression chamber 170 may be partitioned into a plurality of chambers by vane 135. The chamber partitioned by the vane 135 may be divided into suction chamber I which is a portion communicating with a suction port (not shown) and discharge chamber h which is a portion communicating with a discharge port (not shown).

As shown in FIGS. 9 to 11, as rotational shaft 123 rotates, the roller 134 rolls in a state in which an outer circumferential surface of the roller 134 is in contact with an inner circumferential surface of cylinder 136. As shown in FIG. 9, when the contact portion B which is a point at which the outer circumferential surface of the roller 134 contacts with the inner circumferential surface of the cylinder 136 is formed in the area where the vane 135 is located, compression chamber 170 is a chamber.

As shown in FIG. 10, as the contact portion B of the outer circumferential surface of the roller 134 and the inner circumferential surface of the cylinder 136 passes through the area in which the vane 135 is located, the compression chamber 170 may be partitioned into a plurality of chambers by the vane 135. The compression chamber 170 partitioned by the vane 135 may be partitioned into the suction chamber I communicating with the suction port and the discharge port h communicating with the discharge port.

As shown in FIG. 11, as the rotational shaft rotates, the roller 134 rolls in a state in which the outer circumferential surface of the roller 134 is in contact with the inner circumferential surface of the cylinder 136, the contact portion B between the outer circumferential surface of the roller 134 and the inner circumferential surface of the cylinder 136 approaches to the area in which the vane 135 is located. As the volume of the discharge chamber h is reduced, the pressure of a refrigerant accommodated in the discharge chamber h is increased.

As the refrigerant accommodated in the discharge chamber h is compressed, the pressure is applied to the outer circumferential surface of the roller 134. The pressure applied to the outer circumferential surface of the roller 134 may increase a normal force generated between the outer circumferential surface of the eccentric portion 125 and the inner circumferential surface of the roller 134.

A discrete section may be formed between the outer circumferential surface of the eccentric portion 125 and the inner circumferential surface of the roller 134, in which the outer circumferential surface of the eccentric portion 125 and the inner circumferential surface of the roller 134 are not in close contact with each other by an oil supply groove 160 formed on the outer circumferential surface of the eccentric portion 125. When the normal force between the outer circumferential surface of the eccentric portion 125 and the inner circumferential surface of the roller 134 is increased, a lubricating film formed by the oil may be broken in the discrete section formed between the eccentric portion 125 and the roller 134. The frictional force generated between the outer circumferential surface of the eccentric portion 125 and the inner circumferential surface of the roller 134 may be increased at a portion where the lubricating film is broken between the eccentric portion 125 and the roller 134.

Thus, according to one embodiment, as shown in FIGS. 8-9, the rotary compressor is configured such that the oil supply groove 160 is formed at one side of the outer circumferential surface of the eccentric portion 125 divided by a straight line m connecting the center of the rotational shaft 123 and the center of the eccentric portion 125, and refrigerant compressed as the rotational shaft 123 rotates is formed on the opposite side where the center of pressure P applied to the roller acts. That is, the outer circumferential surface of the eccentric portion 125 is divided into two areas with respect to a straight line m connecting the center of the rotational shaft 123 and the center of the eccentric portion 125 so that the oil supply groove 160 is provided in a section in which the oil supply groove 160 is less affected by the pressure that the refrigerant applies. The lubricating film formed by oil between the outer circumferential surface of the eccentric portion 125 and the inner circumferential surface of the roller 134 is not broken by the oil supply groove 160.

Figure 12:
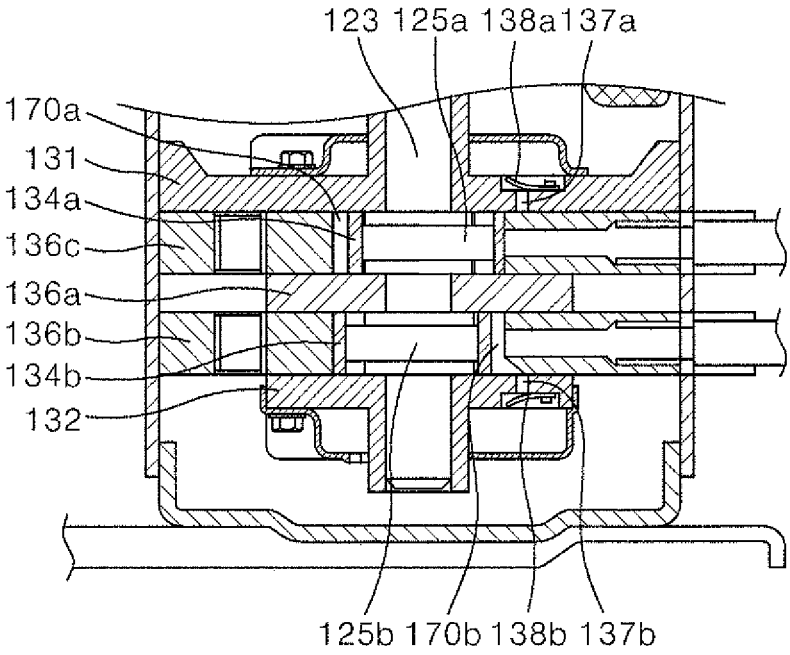
FIG. 12 shows a compression unit provided with two compression portions according to an embodiment.
Figure 13:
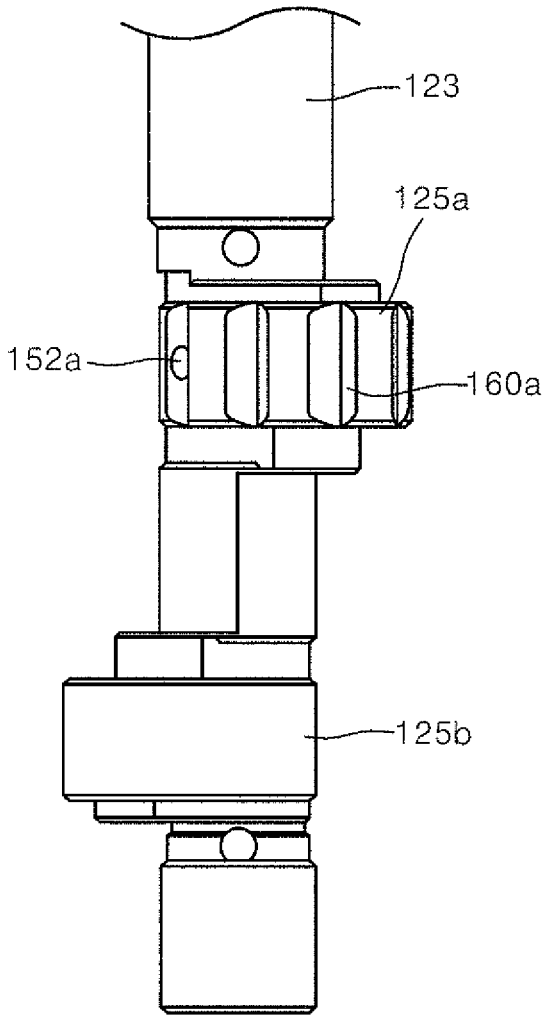
FIG. 13 is a side view of a rotational shaft provided with two eccentric portions according to an embodiment.
Figure 14:
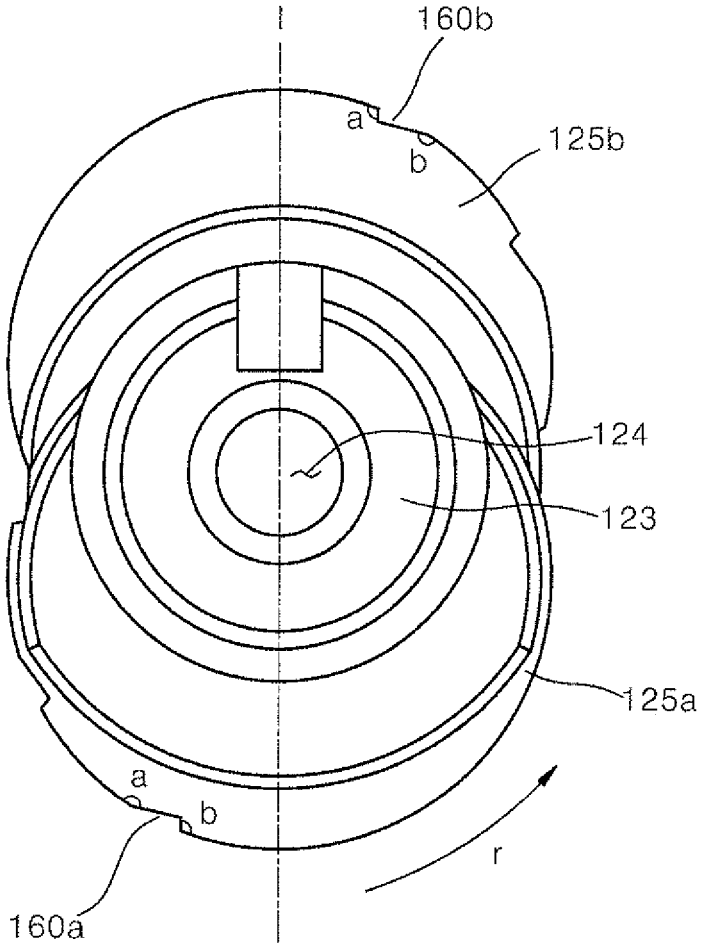
FIG. 14 is a top view of FIG. 13.

FIG. 12 shows a compression unit provided with two compression portions according to an embodiment. FIG. 13 is a side view of a rotational shaft provided with two eccentric portions 125 according to an embodiment. FIG. 14 is a plan view of FIG. 13.

FIG. 12 shows a rotary compressor in which the compression unit is provided with two compression portions. The rotary compressor may include a twin rotary compressor or a two-stage rotary compressor.

As shown in FIG. 12, the twin rotary compressor is provided with two rollers 134 and two cylinders 136 at upper and lower portions and the two rollers 134 and two cylinders 136 provided at the upper and lower portions in the drawing are used for compressing the entire compression capacity by being divided into a portion and a remainder. As shown in FIG. 12, in the two-stage rotary compressor, the two rollers 134 and two cylinders 136 are provided at the upper and lower portions, and the two cylinders 136 communicate with each other so that refrigerant is compressed at a relatively low pressure by one or a first roller and cylinder and the refrigerant is compressed at a relatively high temperature by another or a second roller and cylinder.

The rotary compressor may include a first compression portion and a second compression portion. The first compression portion may include a first cylinder 136*a*, a first eccentric portion 125*a*, a first roller 134*a*, and a first vane (not shown).

The first cylinder 136*a* may form a first compression chamber 170*a* in which a refrigerant may be accommodated in a central portion through which the rotational shaft 123 passes. The first eccentric portion 125 may be provided eccentrically from the rotational shaft 123.

The inner circumferential surface of the first roller 134*a* may be in close contact with the outer circumferential surface of the first eccentric portion 125. As the rotational shaft 123 rotates, the first roller 134*a* may roll in a state in which the outer circumferential surface of the first roller 134*a* is in contact with the inner circumferential surface of the first cylinder 136*a* to compress the refrigerant. The first vane may be inserted into the first cylinder 136*a* and partition the first compression chamber 170*a* into a plurality of chambers.

The second compression portion may include a second eccentric portion 125*b*, a second eccentric portion 125*b*, a second roller 134*b*, and a second vane (not shown). A second cylinder 136*b*, through which the rotational shaft 123 passes, may form a second compression chamber 170*b* in which a refrigerant may be accommodated in the central portion. The second eccentric portion 125*b* may be provided eccentrically from the rotational shaft 123.

An inner circumferential surface of the second roller 134*b* may closely contact the outer circumferential surface of the second eccentric portion 125*b*. As the rotational shaft 123 rotates, the second roller 134*b* may roll in a state in which the outer circumferential surface of the second roller 134*b* contacts the inner circumferential surface of the second cylinder 136*b* to compress the refrigerant. The second vane may be inserted into the second cylinder 136*b* to partition the second compression chamber 170*b* into a plurality of chambers.

A refrigerant compressed in the first compression chamber 170*a* may be discharged to the outside of the first cylinder 136*a* through a first discharge hole 137*a* and a refrigerant compressed in the second compression chamber 170*b* may be discharged to the outside of the second cylinder 136*b* through a second discharge hole 137*b*. First and second discharge valves 138*a* and 138*b* may be formed at the first and second discharge holes 137*a* and 137*b*, respectively, to prevent the refrigerant accommodated in the first and second cylinders 136*a* and 136*b* from being discharged.

The first and second discharge valves 138*a* and 138*b* maintain a state in which the first and second discharge holes 137*a* and 137*b* are closed. When the refrigerant is pressurized to a predetermined pressure or higher, the refrigerant may be discharged to the outside of the first and second cylinders 136*a* and 136*b*.

An intermediate cylinder 136*c* may be disposed between the first compression portion and the second compression portion. The first compression portion and the second compression portion may be spaced apart from the intermediate cylinder 136*c*, respectively. A volume of the first compression chamber 170*a* may be the same as a volume of the second compression chamber 170*b*; however, the volume of the first compression chamber 170*a* may be different from the volume of the second compression chamber 170*b* to vary the volume.

The first eccentric portion 125*a* and the second eccentric portion 125*b* may have a phase difference of 180 degrees and be coupled to the rotational shaft 123. As the first and second eccentric portions 125*a* and 125*b* are formed eccentrically from the rotational shaft 123, respectively, the rotational shaft 123 may be symmetrical with respect to the rotational shaft 123, to reduce vibration that occurs when the rotational shaft 123 rotates.

The oil supply passage 150 may include a first oil supply passage 150*a* that communicates the central passage 124 with the outer circumferential surface of the first eccentric portion 125 and a second oil supply passage 150*b* that communicates the central oil passage 124 with the outer circumferential surface of the second eccentric portion 125*b*. First and second oil supply grooves 160*a* and 160*b* may be provided with first and second oil supply holes 152*a* and 152*b* communicating with the first and second oil supply passages 150*a* and 150*b*, respectively, so that the first and second oil supply passages 150*a* and 150*b* provide communication between the central passage 124 and the first and second oil supply grooves 160 and 160, respectively. This is to enable oil to be supplied in the oil supply groove 160 directly so that a smooth supply of oil to the oil supply groove 160 may be maintained.

In the first oil supply groove 160*a*, an angle between a groove surface disposed rearward with respect to the rotational direction r of the rotational shaft 123 and the outer circumferential surface of the first eccentric portion 125*a* may be an obtuse angle. In the second oil supply groove 160*b*, an angle a between a groove surface disposed rearward with respect to the rotational direction r of the rotational shaft 123 and the outer circumferential surface of the second eccentric portion 125*b* may be an obtuse angle. This structure facilitates flow of the oil between the eccentric portion 125 and the roller 134.

In the first and second oil supply grooves 160*a* and 160*b*, the angle a between the groove surface disposed rearward with respect the rotational direction r of the rotational shaft 123 and the outer circumferential surface of the first and second eccentric portions 125 may be formed larger than an angle b between the groove surface arranged forward with respect to the rotational direction r of the rotational shaft 123 and the outer circumferential surface of the first and second eccentric portions 125. This provides a number of oil supply grooves 160 formed on the outer circumferential surface of the eccentric portion 125.

As shown in FIGS. 14 and 15, according to an embodiment disclosed herein, in the rotary compressor, the first and second eccentric portions 125 may be provided symmetrically about the center of the rotational shaft 123 and the first and second oil supply grooves 160*a* and 160*b* may be formed at one side which is divided by the straight line m connecting centers of the first and second eccentric portions 125, and the refrigerant compressed as the rotational shaft 123 rotates may be formed on the opposite side in which a center of pressure P that is applied to the roller 134 acts. This prevents the lubricating film formed by the oil between the outer circumferential surface of the eccentric portion 125 and the inner circumferential surface of the roller 134 from being broken by the oil supply groove 160.

Embodiments disclosed herein reduces friction loss between an eccentric portion and a roller of a rotary compressor to reduce a mechanical loss of the rotary compressor. Embodiments disclosed herein further improve a mechanical efficiency of a rotary compressor by allowing a smooth oil supply between an eccentric portion and a roller. Embodiments disclosed herein also improve durability and reliability of a rotary compressor by providing a lubrication performance by oil even under conditions that the oil supply of the rotary compressor is insufficient (low speed or an inflow of a liquid refrigerant).

According to embodiments, the rotary compressor may be provided with an oil supply groove on an outer circumferential surface of an eccentric portion in contact with a roller to provide a structure for supplying oil through the oil supply groove. The oil supply groove may be disposed in an angle section before an angle section of initiating a discharge of a refrigerant from the eccentric portion.

Further, the oil supply groove may be disposed in a half-circle section at one side divided by a straight line connecting a center of a rotational shaft and a center of an eccentric section, and may be disposed in a half-circle section where a suction area of the compression chamber is formed as the rotational shaft rotates.

A plurality of oil supply grooves may be disposed on the outer circumferential surface of the eccentric portion in a direction parallel to the rotational shaft. An angle between a groove surface disposed rearward with respect to a rotational direction of the eccentric portion and an outer circumferential surface of the eccentric portion may be an obtuse angle.

This structure can be applied to a case in which a plurality of eccentric portions are provided on a rotational shaft. For example, when two eccentric portions are provided, the two eccentric portions may be disposed to have a phase difference of 180 degrees. In this case, an arrangement area of the eccentric grooves provided in the respective eccentric portions also has a phase difference of 180 degrees.

According to embodiments, the rotary compressor has an effect that oil may be stored in the oil supply groove between the eccentric portion and the roller so that oil may be smoothly supplied between the eccentric portion and the roller and the lubrication may be made, even if the rotary compressor rotates at a low speed. According to embodiments, the rotary compressor also has an effect that lubricity is improved and a friction area is reduced, improving the performance of the compressor and the abrasion of the friction portion is reduced.

According to embodiments, the rotary compressor additionally has an effect that lubrication may be continued by the oil contained between the eccentric portion and the roller even under a condition that the oil supply becomes insufficient, and reliability of the compressor may be provided. According to embodiments, the rotary compressor has an effect that the oil supply may be continuously made between the eccentric portion and the roller under the pressure applied by a refrigerant, and a lubricating film formed between the eccentric portion and the roller may be maintained.

The embodiments are not limited by the embodiments described herein and accompanying drawings. It should be apparent to those skilled in the art that various substitutions, changes and modifications which are not exemplified herein but are still within the spirit and scope may be made. The embodiments should be considered in descriptive sense only and not for purposes of limitation. Therefore, the scope is defined not by the detailed description but by the appended claim.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a rotational shaft coupled to a drive motor to transfer a rotational force and having a central passage formed therein along a longitudinal direction thereof;

an eccentric portion provided eccentrically from the rotational shaft;

a cylinder through which the rotational shaft passes, the cylinder configured to form a compression chamber in which refrigerant is accommodated at a central portion thereof;

a roller an inner circumferential surface of which is in close contact with an outer circumferential surface of the eccentric portion, the roller being configured to roll in a state in which an outer circumferential surface thereof is in contact with an inner circumferential surface of the cylinder as the rotational shaft rotates, and compressing the refrigerant;

a vane inserted into the cylinder, the vane being configured to protrude from the inner circumferential surface of the cylinder when backpressure is applied to the vane to be in contact with the outer circumferential surface of the roller, and to partition the compression chamber into a plurality of chambers; and a plurality of oil supply grooves formed on the outer circumferential surface of the eccentric portion; and an oil supply passage that communicates the central passage with the plurality of oil supply grooves, wherein an angle between a groove surface disposed rearward with respect to a rotational direction of the eccentric portion and the outer circumferential surface of the eccentric portion, in the plurality of oil supply grooves, is an obtuse angle.

2. The rotary compressor of claim 1, wherein the plurality of oil supply grooves is formed on the outer circumferential surface of the eccentric portion in a direction parallel to the longitudinal direction of the rotational shaft.

3. The rotary compressor of claim 1, wherein the plurality of oil supply grooves is disposed in an angle section before an angle section initiating a discharge of the refrigerant, in the eccentric portion.

4. The rotary compressor of claim 3, wherein the angle between the groove surface disposed rearward with respect to the rotational direction of the eccentric portion and the outer circumferential surface of the eccentric portion is formed larger than an angle between a groove surface disposed forward with respect to the rotational direction of the eccentric portion and the outer circumferential surface of the eccentric portion, in the plurality of oil supply grooves.

5. The rotary compressor of claim 1, wherein each of the plurality of oil supply grooves is provided with an oil supply hole that communicates with the oil supply passage, and the oil supply passage provides communication between the central passage and the plurality of oil supply grooves.

6. The rotary compressor of claim 1, wherein the plurality of oil supply grooves is disposed in a half-circle section at one side divided by a straight line connecting a center of the rotational shaft and a center of the eccentric portion, and is disposed in a half-circle section in which a suction area in the compression chamber is formed as the rotational shaft rotates.

7. A rotary compressor, comprising:

a drive motor that generates a rotational force;

a rotational shaft coupled to the drive motor to transfer the rotational force and having a central passage formed therein along a longitudinal direction thereof;

a first compression portion provided with a first cylinder through which the rotational shaft passes, the first cylinder being configured to form a first compression chamber in which refrigerant is accommodated in a central portion thereof, a first eccentric portion provided eccentrically from the rotational shaft, a first roller an inner circumferential surface of which is in close contact with an outer circumferential surface of the first eccentric portion, and as the rotational shaft rotates, the first roller being configured to roll in a state in which an outer circumferential surface thereof is in contact with an inner circumferential surface of the first cylinder and compressing the refrigerant, and a first vane that is inserted into the first cylinder and partitions the first compression chamber into a plurality of chambers;

a second compression portion provided with a second cylinder through which the rotational shaft passes, the second cylinder being configured to form a second compression chamber in which the refrigerant is accommodated in a central portion thereof, a second eccentric portion provided eccentrically from the rotational shaft, a second roller an inner circumferential surface of which is in close contact with an outer circumferential surface of the second eccentric portion, the second roller being configured to roll in a state in which an outer circumferential surface thereof is in contact with an inner circumferential surface of the second cylinder as the rotational shaft rotates, and compressing the refrigerant, and a second vane that is inserted into the second cylinder and partitions the second chamber into a plurality of chambers; and a plurality of first and second oil supply grooves provided on the outer circumferential surface of the first eccentric portion and the outer circumferential surface of the second eccentric portion, respectively, wherein the first and second oil supply passages provide communication between the central passage and the plurality of first oil supply grooves and the plurality of second oil supply grooves, respectively, and wherein an angle between a groove surface disposed rearward with respect to a rotational direction of the first and second eccentric portions and the outer circumferential surface of each of the first and second eccentric portions, in the plurality of first and second oil supply grooves, is an obtuse angle.

8. The rotary compressor of claim 7, wherein the plurality of first oil supply grooves and the plurality of second oil supply grooves are formed on the outer circumferential surface of the eccentric portion in a direction parallel to the longitudinal direction of the rotational shaft.

9. The rotary compressor of claim 7, wherein the angle between the groove surface disposed rearward with respect to the rotational direction of each of the first and second eccentric portions and the outer circumferential surface of the first and second eccentric portions of the plurality of first and second oil supply grooves is formed larger than an angle between a groove surface disposed forward with respect to the rotational direction of each of the first and second eccentric portions and the outer circumferential surface of the first and second eccentric portions.

10. The rotary compressor of claim 7, wherein the first and second eccentric portions are disposed symmetrically with respect to a center of the rotational shaft, and wherein the plurality of first and second oil supply grooves are disposed in a half-circle section at one side divided by a straight line connecting centers of the first and second eccentric portions and are disposed in a half-circle section in which a suction area of a compression chamber is formed as the rotational shaft rotates.

11. A rotary compressor, comprising:

a rotational shaft coupled to a drive motor to transfer a rotational force and having a central passage formed therein along a longitudinal direction thereof;

an eccentric portion provided eccentrically from the rotational shaft;

a cylinder through which the rotational shaft passes, the cylinder configured to form a compression chamber in which refrigerant is accommodated at a central portion thereof;

a roller an inner circumferential surface of which is in close contact with an outer circumferential surface of the eccentric portion, the roller being configured to roll in a state in which an outer circumferential surface thereof is in contact with an inner circumferential surface of the cylinder as the rotational shaft rotates, and compressing the refrigerant;

a vane inserted into the cylinder, the vane being configured to protrude from the inner circumferential surface of the cylinder when backpressure is applied to the vane to be in contact with the outer circumferential surface of the roller, and to partition the compression chamber into a plurality of chambers; and at least one oil supply groove formed on the outer circumferential surface of the eccentric portion; and an oil supply passage that communicates the central passage with the at least one oil supply groove, wherein the at least one oil supply groove is formed on the outer circumferential surface of the eccentric portion in a direction parallel to the longitudinal direction of the rotational shaft, and wherein an angle between a groove surface disposed rearward with respect to a rotational direction of the eccentric portion and the outer circumferential surface of the eccentric portion, in the at least one oil supply groove, is an obtuse angle.

12. The rotary compressor of claim 11, wherein the at least one oil supply groove is disposed in an angle section before an angle section initiating a discharge of the refrigerant, in the eccentric portion.

13. The rotary compressor of claim 12, wherein the angle between the groove surface disposed rearward with respect to the rotational direction of the eccentric portion and the outer circumferential surface of the eccentric portion is formed larger than an angle between a groove surface disposed forward with respect to the rotational direction of the eccentric portion and the outer circumferential surface of the eccentric portion, in the at least one oil supply groove.

14. The rotary compressor of claim 11, wherein each of the at least one oil supply groove is provided with an oil supply hole that communicates with the oil supply passage, and the oil supply passage provides communication between the central passage and the at least one oil supply groove.

15. The rotary compressor of claim 11, wherein the at least one oil supply groove includes a plurality of oil supply grooves disposed in a half-circle section at one side divided by a straight line connecting a center of the rotational shaft and a center of the eccentric portion, and disposed in a half-circle section in which a suction area in the compression chamber is formed as the rotational shaft rotates.

* * * * *